US006260230B1

(12) United States Patent
Hunt

(10) Patent No.: US 6,260,230 B1
(45) Date of Patent: Jul. 17, 2001

(54) FLOOR WASHING AND DRYING METHOD AND APPARATUS

(75) Inventor: Kevin D. Hunt, Milwaukee, WI (US)

(73) Assignee: K. D. Hunt, Inc., Milwaukee, WI (US)

( * ) Notice: Subject to any disclaimer, the term of this patent is extended or adjusted under 35 U.S.C. 154(b) by 0 days.

(21) Appl. No.: 09/425,874

(22) Filed: Oct. 23, 1999

(51) Int. Cl.[7] ..... A47L 13/20; A47L 13/59
(52) U.S. Cl. ..... 15/264; 15/261; 134/6
(58) Field of Search ..... 15/260, 261, 264; D4/53; 134/6

(56) References Cited

U.S. PATENT DOCUMENTS

| | | | | |
|---|---|---|---|---|
| D. 426,361 | * | 6/2000 | Young | D32/53 |
| 1,486,284 | * | 3/1924 | Eiffe | 15/261 |
| 1,767,840 | * | 6/1930 | Finnel | 15/264 |
| 2,049,619 | | 8/1936 | Pavek . | |
| 2,290,217 | * | 7/1942 | Trindl et al. | 15/261 |
| 2,664,584 | | 1/1954 | Twerdahl . | |
| 2,671,239 | | 3/1954 | Wisner . | |
| 2,705,334 | * | 4/1955 | Farrow | 15/264 |
| 3,012,265 | | 12/1961 | Courtenay . | |
| 3,280,418 | * | 10/1966 | Schonberger | 15/261 |
| 4,161,799 | * | 7/1979 | Sorrells | 15/260 |
| 4,174,977 | * | 11/1979 | Shallenberg et al. | 134/6 |
| 4,319,761 | | 3/1982 | Wells . | |
| 4,735,332 | | 4/1988 | Thumser . | |
| 4,798,307 | * | 1/1989 | Evrard | 15/264 |
| 5,063,631 | | 11/1991 | Parker . | |
| 5,611,104 | * | 3/1997 | DeMars | 15/264 |
| 5,976,266 | * | 11/1999 | Anderson et al. | 134/6 |
| 5,983,441 | * | 11/1999 | Williams et al. | 15/261 |
| 6,115,877 | * | 9/2000 | Morad et al. | 15/261 |

* cited by examiner

*Primary Examiner*—Terrence R. Till
(74) *Attorney, Agent, or Firm*—Michael Best & Friedrich LLP

(57) ABSTRACT

A floor washing and drying method and apparatus is provided which includes a first reservoir and a second reservoir. The first reservoir is adapted to hold water or other cleaning liquid in it. The first reservoir also includes a wringer mechanism which may be fixably or removably attached to the first reservoir. The first reservoir is also adapted to be used with a mop having a wetting or washing mop head attached to it. The wringer and the first reservoir are dimensioned such that the washing or wetting mop head may be placed within either the wringer or the first reservoir. The second reservoir is adapted to be used with a mop having a drying mop head attached to it. The drying mop head of the drying mop is dimensioned such that it will fit within the second reservoir but not within the wringer or the first reservoir. The wetting or washing mop and the first reservoir may be like color coded such that they will not be confused for use with the second reservoir or the drying mop which may also be like color coded.

14 Claims, 2 Drawing Sheets

FLOOR WASHING AND DRYING METHOD AND APPARATUS

FIELD OF THE INVENTION

This invention relates generally to units and methods which may be used for washing and drying floors and the like. More particularly, it relates to an apparatus having a first reservoir within which water or other cleaning fluid may be held and also including a device for wringing dry a mop head placed within the wringing device and reservoir. In the preferred embodiment, it relates to such an apparatus which also includes a second reservoir within which is held the mop head of a second drying mop, the head of the second drying mop being made such that it cannot fit within the wringing device and the first reservoir.

BACKGROUND OF THE INVENTION

The use of mops and water buckets for use in cleaning floors and the like is a concept as old as cleaning itself. And as long as there are persons around to clean up after, the use of mops and cleaning buckets is likely to continue for a long time to come. In the experience and observations of the inventor of the present invention, the modern day cleaning bucket has been modified in many ways to make it much more user friendly" and practical. For example, modern cleaning buckets now include rollers or casters upon which the bucket may be rendered highly mobile and readily movable from one dirty location of a floor to another. Modern cleaning buckets also include a wringer mechanism mounted immediately above the reservoir of the clean mop bucket such that the head of a mop may be inserted into the wringer and thus substantially emptied of the water held within the mop head. The water falls back into the bucket reservoir and may be recycled until it is too dirty to be useful.

In the experience of this inventor, the wet-mop method of cleaning is effective but has a significant drawback—the drying time which is necessary to insure that passers by will not fall upon a wet floor is fairly substantial. Most times, particularly in a busy shopping mall or any other place where large numbers of people need to move through, the drying time is simply too long. And the wet floor in such a situation simply creates too great of a risk of harm to those passers by. It is thus advisable and, in fact, quite desirable to have the user of the wetting or washing mop carry around a second drying mop which can then be used to remove the excess water and puddles of water which tend to remain on the freshly cleaned floor. In the experience of this inventor, however, a user faced with two almost identical mops one for wetting and one for drying—soon tends to confuse the two and begins to use them interchangeably. This innocent oversight completely frustrates the purpose behind using the two mops in the first place. And once the drying mop is mistaken for the wetting or washing mop, and becomes completely saturated with water, its usefulness as a drying device is ended. The only solution to this is for the user to find another drying mop to work with.

SUMMARY OF THE INVENTION

It is, therefore, a principal object of this invention to provide a new, useful and uncomplicated method and apparatus for washing and drying a floor or other horizontal surface such that the drying aspect of the device is preserved, which requires only a minimal number of elements and which requires only a minimal number of steps to use in the field. It is another object of this invention to provide such a method and device which provides means to minimize the likelihood that the washing and drying elements of the apparatus and method remain separate and segregated by the user of the method and apparatus.

The present invention has obtained these objects. It provides for a washing and drying apparatus which has a first reservoir and a second reservoir. Although the preferred embodiment of the apparatus of the present invention discloses that the first and second reservoirs may be formed integrally from a single piece of material, it is to be understood that the scope of the present invention would also include an apparatus whereby the second reservoir is removably attachable to the first reservoir and vice versa. The first reservoir of the method and apparatus of the present invention is functionally adapted to hold water or any other cleaning solution within it. The first reservoir also includes a wringer mechanism which may also be fixably or removably attached to the first reservoir, depending upon such arrangement as is desired or required by the user. The first reservoir is functionally adapted to be used with a mop having a wetting or washing mop head attached to it. The wringer and the first reservoir are dimensioned such that the washing or wetting mop head may be placed within either the wringer or the first reservoir. The second reservoir is functionally adapted to be used with a mop having a drying mop head attached to it. The drying mop head of the drying mop is dimensioned such that it will fit within the second reservoir but not within the wringer or the first reservoir. As an additional measure, the wetting or washing mop and the first reservoir may be like color coded such that they will not be confused for use with the second reservoir or the drying mop which are also like color coded. The foregoing and other features of the method and apparatus of the present invention will be further apparent from the description which follows.

DETAILED DESCRIPTION

Figure 1:
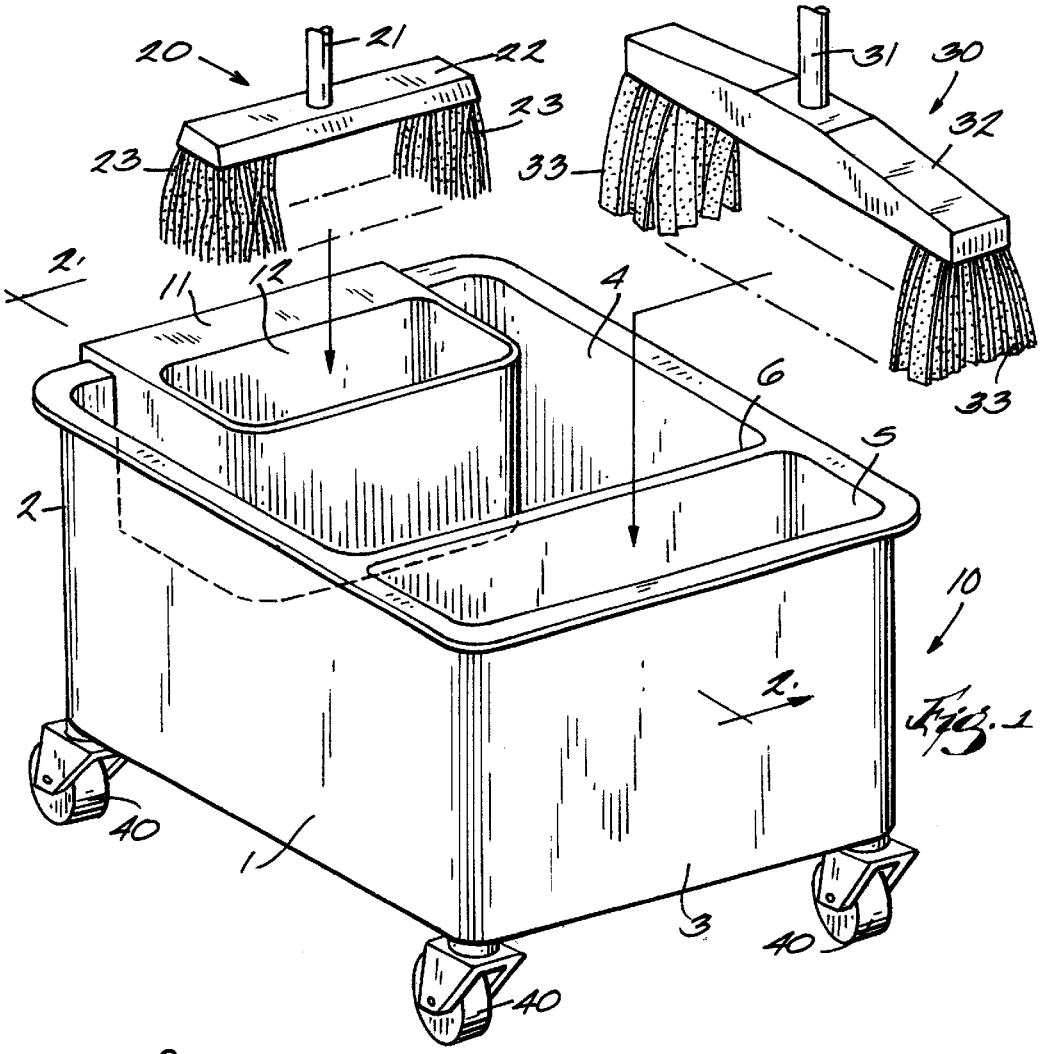
FIG. 1 is a left side and front perspective view showing a washing and drying device constructed in accordance with the present invention.

Referring now to the drawings in detail, FIG. 1 shows a washing and drying device constructed in accordance with the present invention. A preferred embodiment of the device includes a bucket portion, generally identified 10, which includes a main body 1. The main body 1 of the bucket includes a number of wheels or casters 40 affixed to the bottommost portion of the main body 1. This enables the bucket 10 to be highly movable from one site to another by the user as such is desired or required. The main body 1 of the bucket 10 also includes a first reservoir portion 2 and a second reservoir portion 3. Although the first and second reservoir portions 2,3 of the preferred embodiment are shown to be integrally formed of one piece of material, it is to be understood that each of the first and second portions 2,3 could be separately formed, be removably attachable to one another and still come within the scope of this detailed description and the claims which follow.

Figure 2:
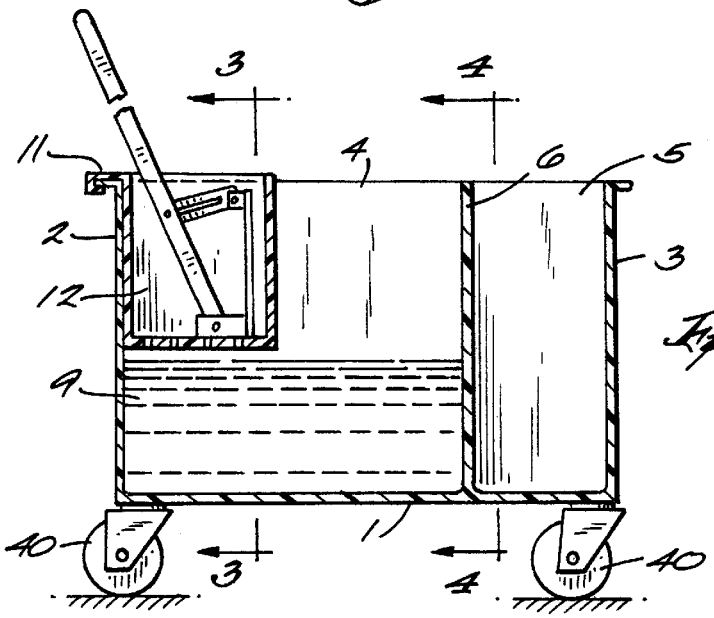
FIG. 2 is a cross-sectional left side elevational view of the washing and drying device shown in FIG. 1 and taken along line 2—2 thereof with the addition of a wringer assembly not illustrated in FIG. 1.

The first and second portions 2,3 of the main body 1 include a first reservoir 4 and a second reservoir 5. The first reservoir 4 and the second reservoir 5 of the preferred embodiment are separated by a dividing wall 6. The first reservoir 4 is functionally adapted to hold a certain volume of water or other cleaning fluid 9 therewithin. See FIG. 2. The second reservoir 5 of the device of the present invention is functionally adapted to remain dry. The purpose of this feature will become apparent further into this detailed description.

The main body 1 of the bucket 10 may be constructed of metal, plastic, fiberglass or any other state of the art material which permits economic fabrication and adequate strength according to the requirements of the device. The same is true of the first and second portions 2, 3, respectively, of the main body 1 whether configured as separate or unitary elements.

The first reservoir 4 of the preferred embodiment also includes a wringer assembly 11 which can be supported by one of the main walls of the first reservoir portion 2 of the bucket 10. Although shown as being a separate part of the bucket 10, it is also to be understood that the wringer assembly 11 of the present invention could be formed as an integral part of the first reservoir portion 2. The wringer assembly 11 could also take different forms and the precise mechanism is not particularly important for purposes of this detailed description. The importance of the wringer assembly 11 is that it is positioned immediately above the water 9 held within the first reservoir 4 of the bucket 10. In this fashion, the mop head portion of a wetting mop, generally identified 20, is receivable within the wringer assembly 11 to remove water 9 therefrom. That water 9 falls back into the first reservoir 4 to be used again.

Figure 3:
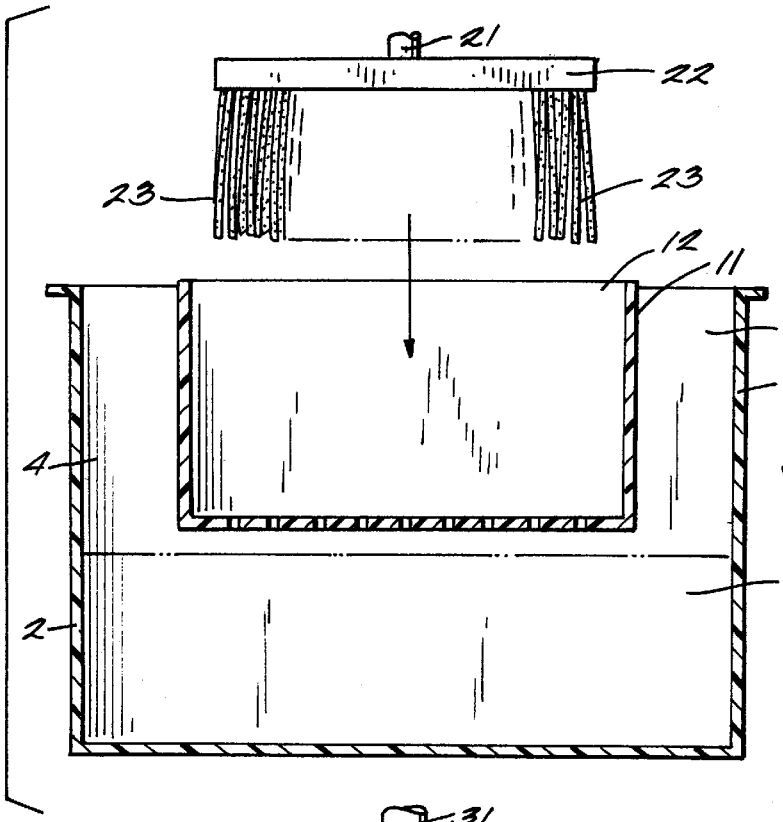
FIG. 3 is an enlarged cross-sectional front elevational view of the device shown in FIG. 2 and taken along line 3—3 thereof.
Figure 4:
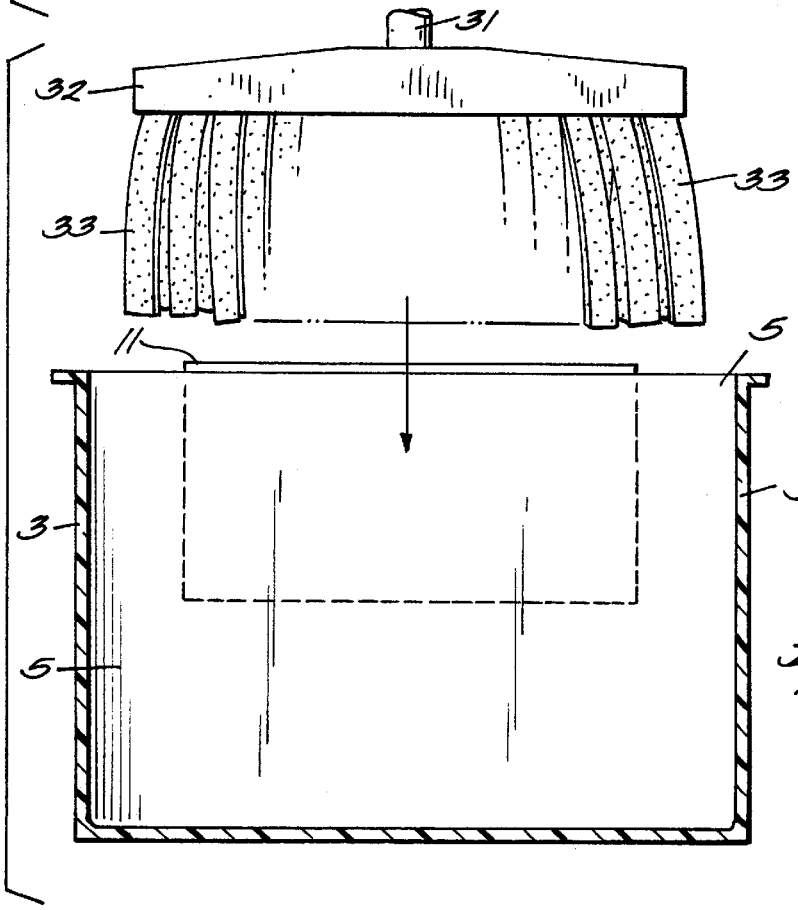
FIG. 4 is an enlarged cross-sectional front elevational view of the device shown in FIG. 2 and taken along line 4—4 thereof.

In the preferred embodiment, a wetting mop 20 is provided which has a mop handle 21, a mop head 22 and the mop fibers 23 which extend from the mop head 22. The mop head 22 of the wetting mop 20 is functionally adapted to fit within the upper end of the wringer assembly 11. See FIG. 3. A second mop, a drying mop, generally identified 30, is also provided. The drying mop 30 of the preferred embodiment includes a mop handle 31, a mop head 32 and mop fibers 33 which extend from the mop head 32. Unlike the mop fibers 23 of the wetting mop 20, the mop fibers 33 of the drying mop 30 are made of highly absorbent material for retaining relatively large amounts of water 9 within them. In the preferred embodiment, the mop head 32 of the drying mop 30 is dimensioned such that it is incapable of being placed within the wringer assembly 11. See FIG. 4. In this fashion, the user of the device of the present invention is likely to not attempt to insert the mop head 32 of the drying mop 30 within the wringer assembly 11 and into the first reservoir 4. Although not disclosed, it is to be understood that the aperture or opening of the first reservoir 4 could likewise be restricted in a dimension such that the wringer assembly 11 would be insertable within the first reservoir 4 but that the mop head 32 of the drying mop 30 could not. As a further feature of the device of the present invention, the inventor has found that color coding of the first reservoir portion 2 and the wetting mop 20, respectively, in a color which contrasts with the color coding of the second reservoir portion 3 and the drying mop 30, respectively, also enhances the distinction between these respective elements such that confusion in use is minimized or avoided altogether.

In application, the user moves the bucket 10 into the general area to be cleaned. The bucket 10 has been prepared in advance and includes a wetting mop 20 which is held in an upright position within and extending from the first reservoir 4 or within the wringer assembly 11. The drying mop 30 is also provided which is held in an upright position as well within and extending from the second reservoir 5. As previously disclosed, the first reservoir 4 contains water or other cleaning solution 9 within it. The second reservoir 5 remains dry. As the user washes the floor with the wetting mop 20, the wetting mop 20 is repeatedly wrung out and reused until a large floor area is clean but still wet. The drying mop 30 is then withdrawn from the second reservoir 5 and used to substantially remove the remaining wetness from the floor. As previously disclosed, the dimensions of the first reservoir 4, the wringer assembly 11, the wetting mop 20, the second reservoir 5 and the drying mop 30 insure that the washing and the drying elements of the method and apparatus of the present invention will not be used interchangeably by the user. The presence of color coding of the different elements also reinforces this notion. The washing and drying cycle is repeated over and over until the floor is completely clean, the cleaning water 9 is too dirty to reuse or the drying mop 30 needs to be replaced with a new and drier mop 30.

From the foregoing, it will be apparent that there has been provided a new and useful a new, useful and uncomplicated method and apparatus for washing and drying a floor or other horizontal surface such that the drying aspect of the device is preserved, which requires only a minimal number of elements and which requires only a minimal number of steps to use in the field and which provides such a method and device which minimizes the likelihood that the washing and drying elements of the apparatus and method remain separate and segregated by the user of the method and apparatus.

The principles of this invention having been fully explained in connection with the foregoing, I hereby claim as my invention:

1. An apparatus for washing and drying a floor which comprises a first reservoir configured to hold a liquid within it, a second reservoir situated adjacent said first reservoir, a first mop including a mop head and a plurality of washing fibers extending from said mop head, said washing fibers being capable of transferring liquid by absorption from said first reservoir to the floor, and said mop head of said first mop being configured to fit within said first reservoir, a wringer mechanism sized to receive said mop head and washing fibers of said first mop therewithin and situated such that liquid wrung from said washing fibers of said first mop is deposited into said first reservoir, and a second mop including a mop head and at least one water absorbing member extending from said mop head of said second mop, said mop head of said second mop being configured to fit within said second reservoir but being dimensioned such that it is incapable of fitting within said first reservoir.

2. The apparatus of claim 1 wherein the mop head of said second mop is dimensioned such that it is incapable of fitting within said wringer mechanism.

3. The apparatus of claim 1, wherein said first reservoir and said second reservoir are formed integrally with one another.

4. The apparatus of claim 1, wherein said first reservoir and said first mop are color coordinated with one another.

5. The apparatus of claim 1, wherein said second reservoir and said second mop are color coordinated with one another.

6. A method for assembling a mopping system, the method comprising:

providing a first liquid holding reservoir, providing a first mop sized to be received within the first reservoir, forming a second reservoir integrally with and adjacent to the first reservoir, and providing a second mop sized to be received within the second reservoir.

7. The method of claim 6, further comprising providing a wringer assembly sized to be used with the first reservoir.

8. The method of claim 7, further comprising color coordinating the first reservoir, the wringer assembly, and the first mop, and color coordinating the second reservoir and the second mop.

9. The method of claim 7, wherein said act of providing a second mop includes dimensioning the second mop to be incapable of being received within the wringer assembly.

10. The method of claim 6, wherein said act of providing a second mop includes dimensioning the second mop to be incapable of being received within the first reservoir.

11. The method of claim 6, further comprising color coordinating the first reservoir and the first mop, and color coordinating the second reservoir and the second mop.

12. A method for assembling a mopping system, the method comprising providing a first reservoir configured to hold liquid within it, providing a second reservoir situated adjacent the first reservoir, providing a first mop for transferring water by absorption from the first reservoir to the floor, the first mop being configured to fit within the first reservoir, providing a wringer mechanism to be used with the first reservoir, providing a second mop for transferring water by absorption from the floor to the second mop, color coordinating the first reservoir and the first mop, and color coordinating the second reservoir and the second mop.

13. The method of claim 12, further comprising dimensioning the second mop to be incapable of being received within the wringer mechanism.

14. The method of claim 12, further comprising dimensioning the second mop to be incapable of being received within said the first reservoir.

* * * * *